United States Patent [19]

Burns

[11] 4,453,576

[45] Jun. 12, 1984

[54] APPARATUS FOR FILLING CONTAINERS SUCH AS COMMUNION CUPS

[76] Inventor: W. Mike Burns, 101 29th St., Gulfport, Miss. 39501

[21] Appl. No.: 422,591

[22] Filed: Sep. 24, 1982

[51] Int. Cl.[3] ..... B67D 5/00

[52] U.S. Cl. ..... 141/168; 141/129; 211/78

[58] Field of Search ..... 141/1, 115, 130, 163, 141/165, 167, 168, 177, 283, 284, 237; 211/77, 78; 251/9; 269/57, 305

[56] References Cited

U.S. PATENT DOCUMENTS

| | | | |
|---|---|---|---|
| 2,070,055 | 2/1937 | Levien | 211/77 |
| 2,235,660 | 3/1941 | Wiepert | 211/131 X |
| 2,654,522 | 10/1953 | Gorham | 141/130 X |
| 2,740,081 | 3/1956 | McKay et al. | 141/130 X |
| 3,196,909 | 7/1965 | Monk | 141/237 |
| 3,335,753 | 8/1967 | Kiser | 251/9 X |
| 3,592,095 | 7/1971 | Passa et al. | 269/57 X |
| 3,599,959 | 8/1971 | Asenbauer | 269/57 |
| 4,323,097 | 4/1982 | Achen | 141/168 |
| 4,373,840 | 2/1983 | Miller, Jr. | 269/57 X |

*Primary Examiner*—Stephen Marcus
*Assistant Examiner*—Mark Thronson
*Attorney, Agent, or Firm*—L. S. Van Landingham, Jr.

[57] ABSTRACT

An improved apparatus is disclosed for filling containers with a liquid. The apparatus is very efficient and the containers may be filled in a small fraction of the time formerly required. The flow of liquid into the containers may be controlled with great precision and without spilling or wasting the liquid. The filling spout has the added advantage of being dripless. The apparatus is especially useful in filling a large number of small open top containers such as communion cups with a liquid such as grape juice.

21 Claims, 6 Drawing Figures

APPARATUS FOR FILLING CONTAINERS SUCH AS COMMUNION CUPS

THE BACKGROUND OF THE INVENTION

1. The Field of the Invention

The present invention broadly relates to an improved apparatus for filling containers with a liquid. The invention is especially useful in filling a plurality of small containers such as communion cups and will be illustrated and described hereinafter for this purpose.

2. The Prior Art

A large number of prior U.S. patents are concerned with apparatus for filling various types of containers with a wide variety of liquids. Some examples of U.S. patents which have issued in this general field include U.S. Pat. Nos. 156,518, 989,503, 2,070,055, 2,235,660, 2,852,222, 2,652,261, 2,718,985, 2,752,068, 3,095,667, 3,155,383, and 3,747,809. The above patents disclose certain features of the apparatus of the invention to be described hereinafter such as valve assemblies for controlling the flow of liquids, slides which are mounted for general horizontal sliding movement, and rotary turntables for horizontal rotating movement. However, these patents do not disclose the combination of elements which are essential in practicing the present invention as disclosed and claimed hereinafter in combination.

More specifically, the prior art is not concerned with apparatus which is especially useful in filling a large number of small open top containers such as communion cups with a liquid such as grape juice. The apparatus of the invention is very efficient in this respect, and the communion cups may be filled in a small fraction of the time formerly required. Additionally, the liquid may be dispensed into the communion cups with great precision and without either overfilling or under filling. As added advantages, the filling spout is dripless and the liquid may be dispensed without spilling or wasting the same. These important advantages of the present invention are not found in the prior art mentioned hereinbefore.

THE SUMMARY OF THE INVENTION

The present invention overcomes the disadvantages and deficiences of the prior art. This is accomplished by providing the improved apparatus for filling containers with a liquid which is disclosed hereinafter.

The apparatus of the invention includes a longitudinally extending base. The base has a longitudinally extending slide guide means for receiving a slide in slidable relationship thereto, and a slide is slidably mounted therein for longitudinal inward and outward movement with respect to the base. A rotatable turntable is provided which includes means for supporting a plurality of containers to be filled on or above its upper surface. The turntable is mounted on means carried by the slide and in spaced relationship with respect to the upper surface of the slide. A container is provided for storing liquid to be dispensed. Liquid withdrawal and dispensing means are also provided for withdrawing liquid from the container and dispensing controlled amounts thereof into the plurality of containers to be filled. The container for storing the liquid is mounted above the upper surface of the turntable, and the means for withdrawing the liquid from the container and dispensing controlled amounts thereof is mounted beneath the storage container and above the upper surface of the turntable whereby the liquid may be withdrawn and dispensed with the aid of gravity. The above mentioned elements and components of the apparatus of the invention will be described and referred to in greater particularity hereinafter.

THE BRIEF DESCRIPTION OF THE ACCOMPANYING DRAWINGS

The invention will be described hereinafter in greater particularity with reference to the presently preferred embodiments thereof illustrated in the accompanying drawings, wherein.

Figure 1:
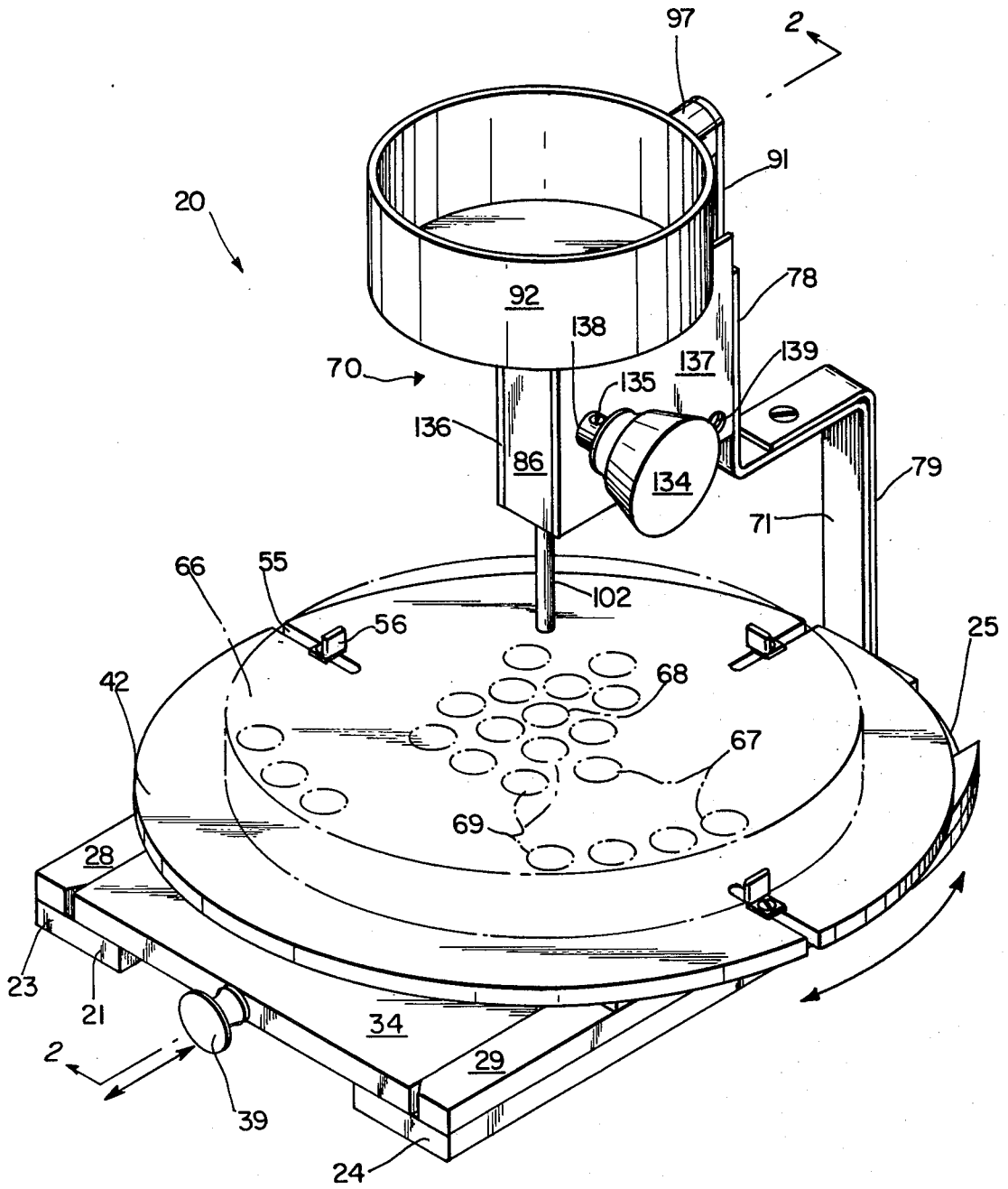
FIG. 1 is a right front perspective view of one presently preferred embodiment of the apparatus of the invention, which further illustrates in phantom line a prior art communion tray and communion cups positioned thereon for filling.
Figure 2:
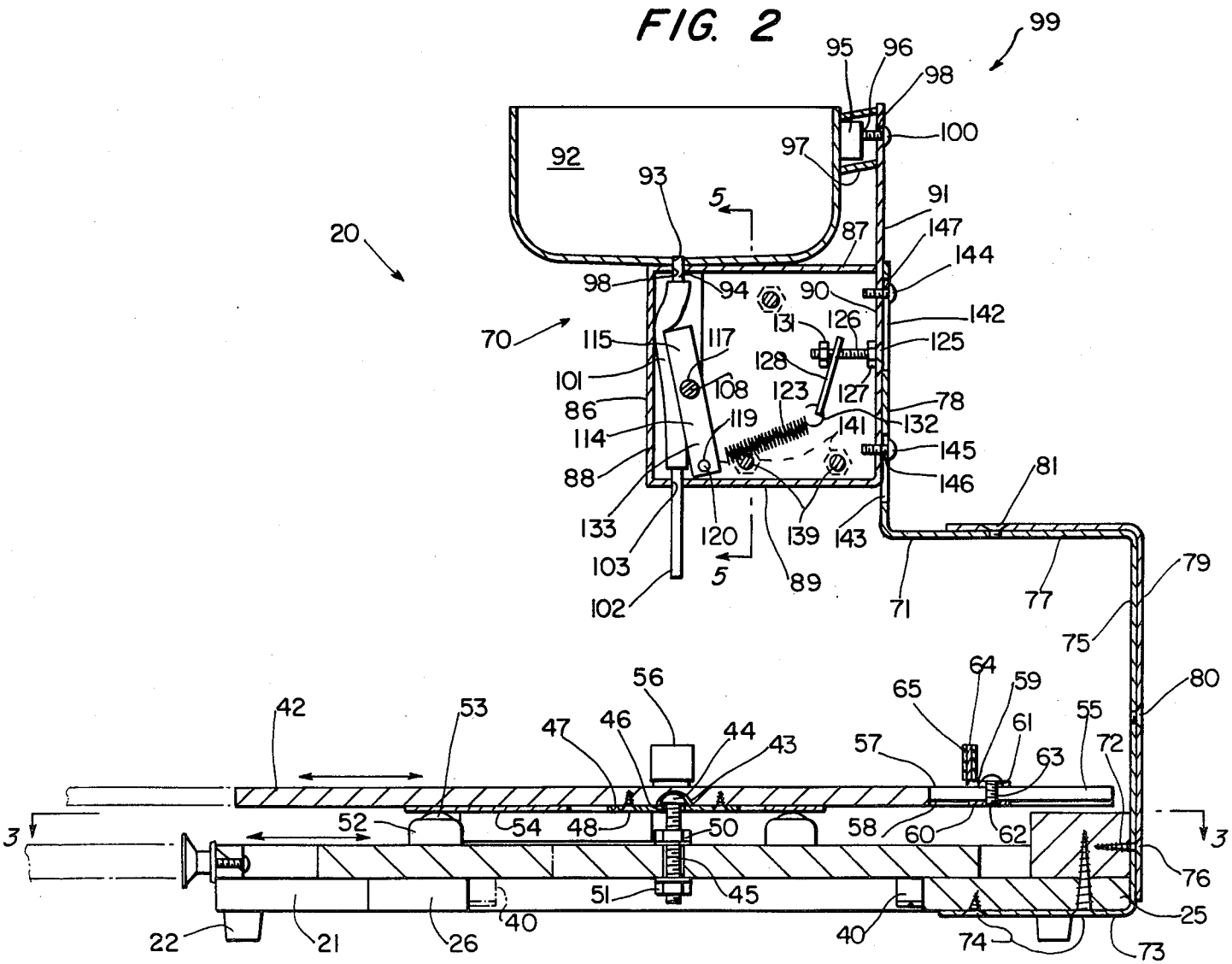
FIG. 2 is a longitudinal cross sectional view taken along the line 2—2 of FIG. 1, which further illustrates the slide in its maximum outward position in phantom line.
Figure 3:
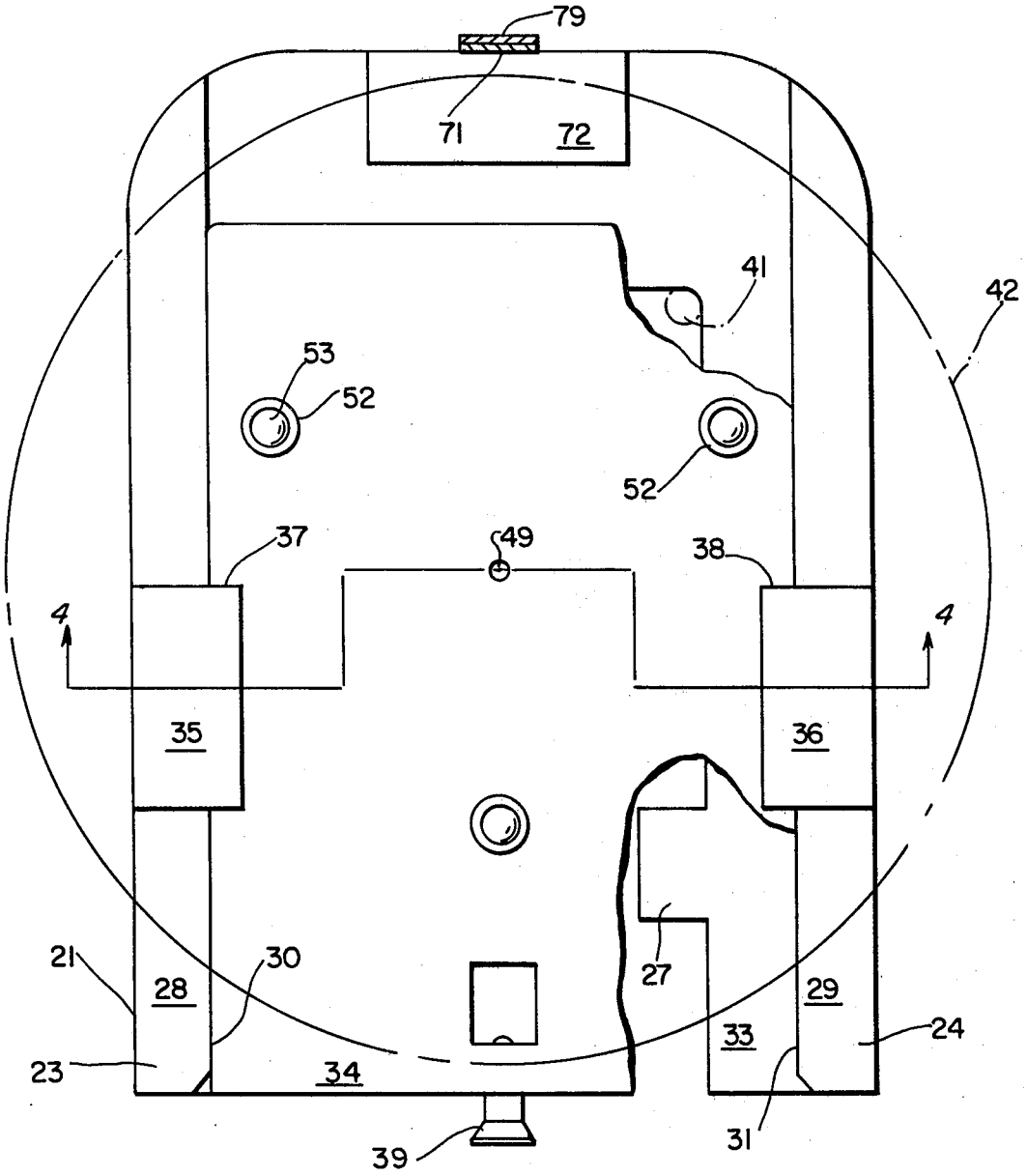
FIG. 3 is a cross sectional view taken along the line 3—3 of FIG. 2.
Figure 4:
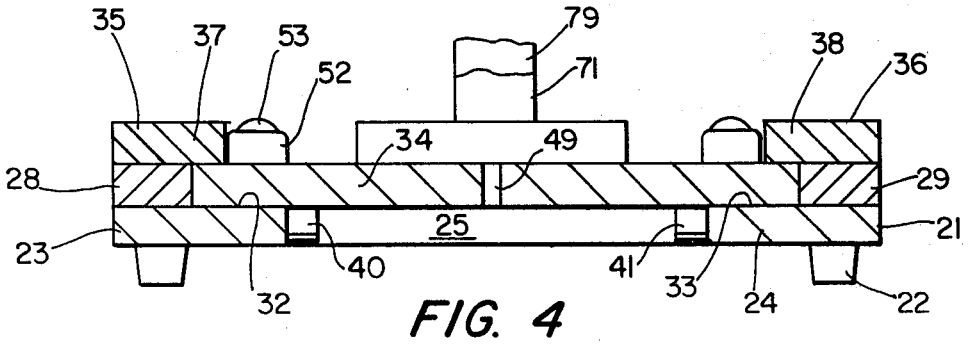
FIG. 4 is a transverse cross sectional view taken along the line 4—4 of FIG. 3.
Figure 5:
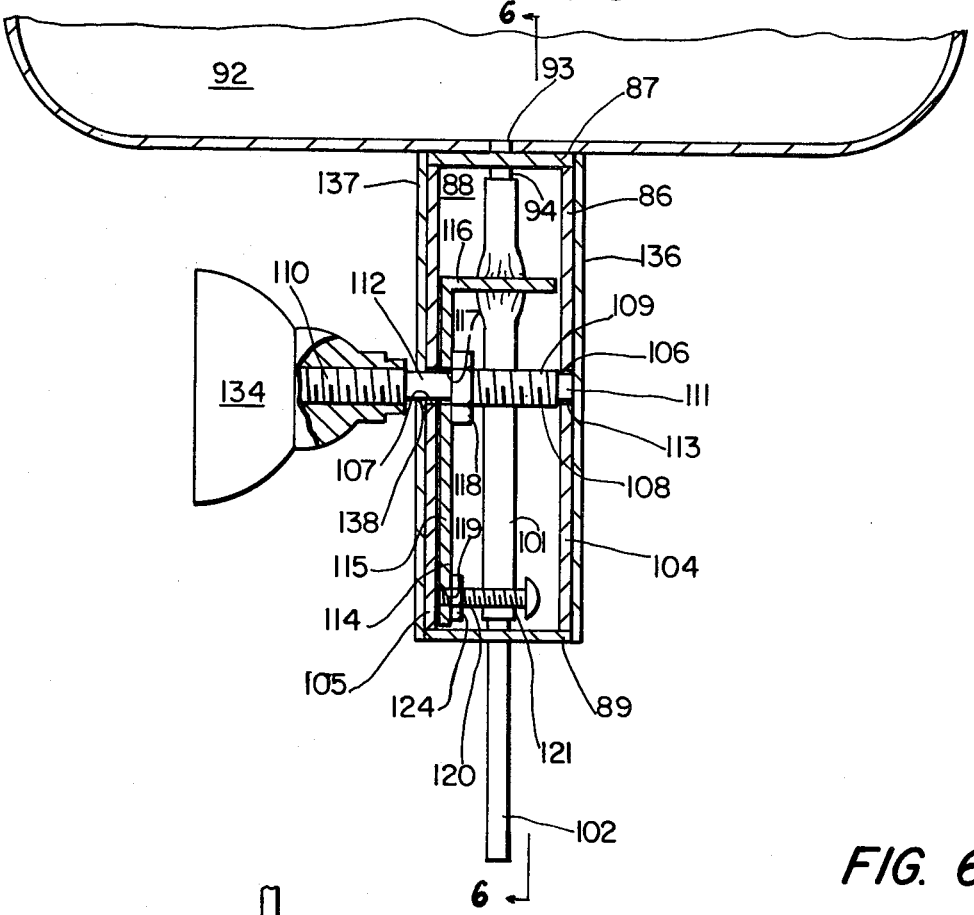
FIG. 5 is an enlarged fragmentary view taken along the line 5—5 of FIG. 2 illustrating certain features of the liquid storage and dispensing apparatus.
Figure 6:
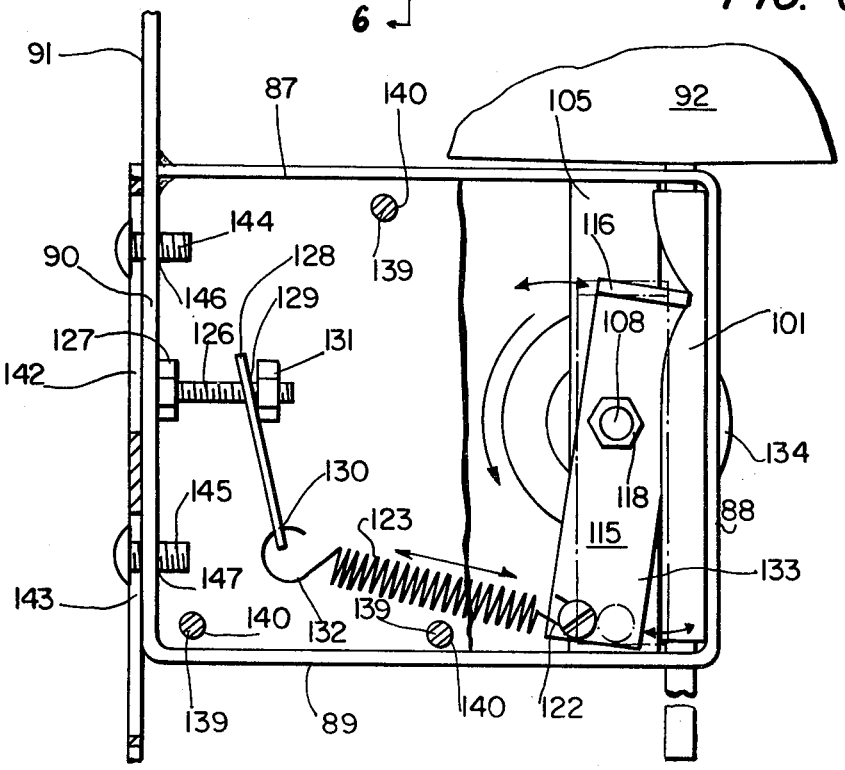
FIG. 6 is a further enlarged fragmentary view taken along the line 6—6 of FIG. 5 illustrating certain other features of the liquid storage and dispensing apparatus.

THE DETAILED DESCRIPTION OF THE INVENTION INCLUDING THE PRESENTLY PREFERRED EMBODIMENT THEREOF

Referring now to the drawings, which illustrate one presently preferred embodiment of the invention, the apparatus for filling containers such as communion cups generally designated as 20 includes a generally U-shaped base 21 which is provided on its lower surface with a plurality of spaced mar and skid resistant rubber feet 22. The base 21 has a pair of spaced longitudinally extending left and right legs 23 and 24, respectively, which are connected on their inner ends to a transversely extending portion 25, and which have inwardly projecting stops 26 and 27, respectively, adjacent the outer ends thereof. The left and right legs 23 and 24 are substantially parallel and are provided on the outer edges of their upper surfaces with longitudinally extending guide members 28 and 29, respectively, which have substantiallv parallel inner side edges 30 and 31, respectively, that are positioned approximately midway of the longitudinally extending upper surfaces of legs 23 and 24. This arrangement provides longitudinally extending surfaces 32 and 33 which are inward of guide members 28 and 29, respectively, and therefore available for slidably supporting the side edges of slide 34. The upper surfaces of guide members 28 and 29 are provided with longitudinally extending retaining strips 35 and 36, respectively, which have inner side edges 37 and 38 that extend inward pass the side edges 30 and 31, respectively and thereby prevent undue upward movement of slide 34 and retain it in a proper slidable relationship.

As will be recognized by those skilled in this art, the upper surfaces 32 and 33, the substantially parallel inner side edges 30 and 31 and the overlapping inner side edges 35 and 36 are arranged and positioned to thereby form a slide guide for the slide 34 and allow it to be moved inward and outward within predetermined limits by means of push-pull knob 39. The lower inner surface of slide 34 is provided with a pair of left and right spaced downwardly projecting stops 40 and 41, respectively. The maximum limits of slidable inward and outward movement of slide 34 are determined by stops 26, 27, 40 and 41 and the transversely extending portion 25. For example, the slide 34 may be pushed inward by knob 39 until the stops 40 and 41 strike the outer edge of transversely extending portion 25. Similarly, the slide 34 may be pulled outward by knob 39 until the stops 40 and 41 strike the inner edges of stops 26 and 27, respectively.

The round turntable 42 is rotatably mounted in adjustable spaced relationship above slide 34 and is carried thereby. This is conveniently accomplished in the embodiment illustrated in the drawings by providing a recessed area 43 in the center undersurface of table 42 for receiving head 44 of threaded bolt 45. The bolt 45 is passed through opening 46 in mounting plate 47 and the head 44 is retained in recess 43 by securely attaching the mounting plate 47 to the undersurface of table 42 by means of screws 48. The threaded bolt 45 is then passed downward through opening 49 in slide 34 and is securely attached to slide 34 by adjustable thread upper and lower nuts 50 and 51, respectively. The upper surface of slide 34 is provided with three bearing assemblies 52 which are spaced around opening 49 circumferentially at approximately each 120°. The bearing assemblies 52 have bearings 53 rotatably mounted therein so as to project upward therefrom a distance sufficient to contact the wearplate 54. The construction is such that the head 44 and threaded bolt 45 are free to rotate in the recessed area 43 and opening 46, respectively, upon rotation of table 42, but bolt 45 is prevented from rotating in opening 49 due to slide 34 being tightly clamped between upper and lower nuts 50 and 51. This arrangement allows the height of table 42 to be adjusted so that the lower surface of wear plate 54 rests upon bearings 53 by threadedly adjusting the upper nut 50 up or down on threaded bolt 45 as necessary, and then tightening the threaded lower nut 51 on threaded bolt 45 to thereby securely clamp slide 34 between nuts 50 and 51.

The table 42 is provided with three slots 55 which are circumferentially spaced at approximately 90°. The slots 55 extend from the outer circumference of table 42 inward toward the center thereof a distance sufficient to allow the communion tray diameter adjusting means 56 to accommodate the various diameters of communion trays commonly in use. The upper and lower surfaces of table 42 adjacent the slots 55 are recessed sufficiently to provide upper and lower slide guides 57 and 58 which receive the upper slide portion 59 and the lower slide portion 60, respectively, of adjusting means 56. The upper slide portion 59 has an opening 61 for receiving threaded screw 63, and lower slide portion 60 has a threaded opening 62 therein which is in threaded engagement with the threads on screw 63. Upon loosening screw 63, the slide portions 59 and 60 may be moved along slot 55 to a desired position and then retained in place at the desired position by tightening screw 63 in threaded opening 61. The upper slide portion 59 has an upwardly projecting portion 64 which is provided with a soft non-marring resilient rubber layer 65 that contacts the outer edges of the communion tray 66 when it is properly positioned upon the table 42. It is understood that the adjusting means 56 in each of the three slots 55 is adjusted as necessary to accommodate the diameter of the particular communion tray to be used and to thereby allow the center of the communion tray to rest above the center of the table 42.

The fluid storage and dispensing mechanism 70 is supported above the turntable 42 by means of metal mounting strip 71. In the embodiment illustrated in the drawings, a mounting block 72 is provided on the inner end of the upper surface of member 25 to aid in securely attaching the strip 71 to the base 21. The strip 71 includes a first horizontally and inwardly extending portion 73 which is attached by means of screws 74 to the undersurface of member 25, a first vertical portion 75 extending upward therefrom and attached to block 72 by means of screw 76, a second horizontally and outwardly extending portion 77, and a second vertically extending portion 78. A generally L-shaped reinforcing strip 79 is attached to portions 75 and 77 by means of screws 80 and 81, respectively, and to block 72 and strip portion 75 by means of screw 76 for the purpose of strengthening the strip 71 at its weakest points.

The dispensing mechanism 70 includes a generally square shaped supporting framework constructed from a continuous length of metal strip 86. The initial end of the strip 86 has a first horizontally and outwardly extending portion 87 which terminates in a first vertical portion 88 that extends downward therefrom. The first vertical portion 88 terminates in a second horizontally and inwardly extending portion 89, which in turn terminates in a second vertical and upwardly extending portion 90. The initial end of strip 86 is joined, such as by welding, to the second vertical portion 90 to strenghten the framework, and the terminal end thereof extends upward a substantial distance past the joint to provide a terminal end portion 91 for use in mounting fluid container 92 above portion 87 of strip 86.

The fluid container 92 has an opening 93 in the bottom thereof and a short piece of copper tubing 94 in water tight relationship therewith extends downward therefrom to provide an outlet for the fluid. The outer surface of container 92 has an extension 95 with a threaded opening 96 therein, and a cover 97 is provided therefor which also serves as a spacer. The outer end of horizontal portion 87 has an opening 98 formed therein and the copper tubing 94 is inserted therethrough with the bottom of fluid container 92 resting on the upper surface of horizontal portion 87. An opening 99 is formed adjacent the outer end of terminal end portion 91 and a threaded screw 100 is inserted therethrough and is in tight threaded engagement with the threads in threaded opening 96 to thereby complete the mounting of container 92.

The terminal end portion of copper tubing 94 is inserted into the upper end of a short length of soft resilient rubber tubing 101, and a second short length of copper tubing 102 is inserted in the lower end thereof. An opening 103 is formed adjacent the outer end of the second horizontal portion 89 which is in vertical alignment with opening 98. The copper tubing 102 is inserted through opening 103 and extends downward therefrom and serves as a filling spout for containers such as communion cups, as will be described more fully hereinafter.

The internal diameter of the rubber tubing 101 is such that a fluid tight seal is formed when the terminal end portions of copper tubing 94 and 102 are inserted therein. Thus, inasmuch as openings 98 and 103 are in vertical alignment and copper tubing 94, rubber tubing 101 and copper tubing 102 are likewise in substantial vertical alignment, fluid contained in container 92 will normally flow through the opening 93 and pass progressively downward through copper tubing 94, rubber tubing 101 and copper tubing 102 in the form of a continuously flowing stream. However, it has been discovered that the flow of fluid through rubber tubing 101 may be controlled with great precision, and without loss of fluid due to leaking, spilling, or dripping from the end of copper tubing 102, by applying pressure to the external surface of rubber tubing 101 thereby preventing the flow of fluid therethrough normally, and releasing the pressure only when it is desired that fluid flow from the copper tubing 102.

The control over the flow of fluid through tubing 101 is conveniently accomplished by providing a pair of oppositely disposed metal strips 104 and 105 which extend vertically between the first and second horizontal portions 87 and 89 and are attached at their upper and lower ends to the left and right side edges thereof, respectively. Aligned openings 106 and 107 are formed in metal strips 104 and 105, respectively, at points approximately midway their length and an intermittently threaded rod 108 is inserted first through opening 107 and then into opening 106. The rod 108 has first and second threaded portions 109 and 110 and first and second unthreaded portions 111 and 112, respectively. The unthreaded portions 111 and 112 are positioned within openings 106 and 107, respectively, and the rod 108 is rotatably mounted therein. The unthreaded portion 112 and the threaded portions 109 and 110 have substantially the same outside diameters and all may be passed through opening 107. However, unthreaded portion 111 has a markedly smaller outside diameter thereby forming a shoulder 113 at the juncture with threaded portion 109. The opening 106 is sufficiently large to receive unthreaded portion 111 and allow rotary movement therein, but it is not sufficiently large to receive threaded portion 109. Thus, shoulder 113 abuts strip 104 adjacent the opening 106 and prevents further outward movement of rod 108 through opening 106.

The L-shaped metal strip 114 is fixedly mounted on rod 108 so that the longer leg 115 fits adjacent the inside surface of strip 105 and the shorter leg 116 extends inward toward strip 104. This may be conveniently accomplished by providing a threaded opening 117 in leg 115, and then threading the same on the threads of the threaded portion 109 until the ends of the threads are reached adjacent the unthreaded portion 112. A nut 118 in threaded engagement with the threads on the threaded portion 109 is then tightened against the metal strip 114 to retain it in place and prevent further undesired rotary movement relative to rod 108. Thus, rotation of rod 108 results in rotation of strip 114. Inasmuch as the threads of threaded portion 109 extend along rod 108 between the strips 104 and 105, with the exception of providing for a slight clearance, it is apparent that the leg 115 is fixedly mounted on rod 108 closely adjacent the strip 105 and, upon rotation of rod 108, moves relative to strip 105. The strip 114 has a threaded opening 119 formed adjacent the outer end of leg 115 which has the end only of screw 120 in threaded engagement therewith so as to provide a portion 121 extending outward from opening 119 for receiving the lower end 122 of spring 123. A nut 124 is in threaded engagement with the threads on screw 120 and is tightened so as to be in frictional engagement with leg 115 for the purpose of preventing undesired rotation of screw 120 and thereby maintaining it properly positioned. The second vertical portion 90 of strip 86 has an opening 125 formed therein for receiving a flat-headed screw 126. The screw 126 extends outward from opening 125 toward the first vertical portion 88 and is provided with a nut 127 in threaded engagement therewith and tightened against vertical portion 90 and in frictional engagement therewith for the purpose of stabilizing and maintaining screw 126 in the desired position illustrated in the drawings. Screw 126 extends outward past nut 127 a substantial distance and a relatively short and narrow metal strip 128 having upper and lower openings 129 and 130, respectively, formed therein is adjustably mounted thereon by means of outer nut 131. The screw 126 is inserted through opening 129 and nut 131 is threaded on the outer end of screw 126. The strip 128 extends downward from screw 126 and the upper end 132 of spring 123 is inserted through opening 130. The amount of tension on spring 123 is then adjusted as desired by tightening or loosening nut 131. The tension is adjusted so that it is sufficient to cause lower end 133 of leg 115 to move inward toward vertical portion 90, which in turn causes rod 108 to be rotated counterclockwise in openings 106 and 107 and leg 116 to move outward toward vertical portion 88. The resilient rubber tubing 101 is clamped between the transverse leg 116 and the inner surface of vertical portion 88 and is compressed thereby sufficiently to seal off the opening in tube 101 and prevent the flow of liquid therethrough. Liquid is prevented from flowing through tube 101 so long as the tension on spring 123 is properly adjusted by nut 131 to apply sufficient force via transverse leg 116 to seal off the opening in tube 101. However, by rotating rod 108 clockwise with sufficient force, it is possible to overcome the tension on spring 123 and cause end 133 to move outward toward vertical portion 88 and leg 116 to move inward toward vertical portion 90. An internally threaded filler knob 134 is in threaded engagement with threaded portion 110 of rod 108 and is retained in a desired position and prevented from undesirable rotation by means of set screw 135. The threaded portion 110 preferably has right handed threads whereby rotating knob 134 clockwise tends to tighten it on rod 108. Upon rotating knob 134 clockwise with sufficient force and circumferential movement, the transverse leg 116 moves inward a sufficient distance toward vertical portion 90 to allow tubing 101 to assume its normal round configuaration and allow liquid to pass downward therethrough and then through copper tubing 102 which serves as a filling spout. Upon release of knob 134, the transverse leg 116 is immediately moved back toward vertical portion 88 due to the continuous tension on spring 123 and rubber tubing 101 is again compressed thereby and liquid is prevented from flowing therethrough.

The aforementioned mechanical elements of the dispensing mechanism 70 positioned within the portions 87–90 of metal strip 86 are enclosed and hidden from view by means of left and right side panels 136 and 137, respectively. The right panel 137 is provided with an opening 138 and rod 108 is inserted therethrough a sufficient distance to threadedly attach internally threaded filler knob 134 on threaded portion 110. The panels 136 and 137 are retained in position adjacent the left and right sides, respectively of metal strip 86 by bolts 139 which pass through aligned openings 140 and are retained in position by nuts 141. The vertically extending strip portion 78 is provided with spaced longitudinally extending upper and lower slots 142 and 143 which receive upper and lower set screws 144 and 145, respectively. Threaded upper and lower openings 146 and 147 are formed in vertical strip portion 90 to receive the threads on set screws 144 and 145, respectively, in threaded engagement therewith. Thus, the fluid storage and dispensing mechanism 70 may be adjusted upward or downward as desired by loosening set screws 144 and 145 and making the vertical ajustment as needed by sliding set screws 144 and 145 along slots 142 and 143, respectively, and then retightening set screws 144 and 145 to retain the desired adjustment.

The communion tray 66 and communion cups 67 shown in phantom line do not comprise a part of the invention. However, the apparatus described herein is especially useful in connection with prior art round communion trays of the type most commonly used today, and on which the communion cups 67 are usually arranged in concentric circles or rows 69, as illustrated in the drawings. Often a center communion cup 68 is positioned in the center of the communion tray 66 and concentric rows 69 of communion cups 67 are arranged therearound. The communion trays currently in use vary in diameter and height, and the communion cups also vary in these respects. The apparatus of the invention provides adjusting means to accommodate the various different sizes of communion trays and cups in use. The apparatus disclosed herein also provides liquid storage and dispensing means whereby the numerous communion cups 67 may be filled rapidly and easily, and without danger of spilling or wasting the liquid, or drops of liquid dripping from the copper tubing 102 used as a filling spout.

There are several important relationships between the various components and elements of the apparatus of the invention. For example, a vertical plane passing through the longitudinal centerline of the base 21 also passes through the longitudinal centerline of the slide 34, the push-pull knob 39, the mounting strip 71, the reinforcing strip 79 and the strip 86. The vertical plane passing through the longitudinal centerline of the base 21 also bisects and divides into two equal mirror-image halves the base 21, the slide 34, the push-pull knob 39, the mounting block 72, the strips 71, 79 and 86, the container 92 and opening 93 therein, the copper tubing 94, the rubber tubing 101 the copper tubing 102 used as a filling spout, the communion tray 66, the turntable 42 when the communion tray adjusting means 56 is in the position illustrated in FIG. 1 of the drawings, the recessed area 43, the threaded bolt 45 and openings 46 and 49. Additionally, when the turntable and slide 34 are in the position illustrated in FIG. 1 of the drawings in solid line, i.e., when moved to their maximum inward positions as determined by stops 40 and 41 striking transversely extending portion 25, a vertical plane passing transversely through the center of turntable 42 also passes through the opening 93 in container 92, the copper tubing 94, the rubber tubing 101, the copper tubing 102 serving as a filling spout, the center of turntable 42, the recessed area 43, the bolt 45 and the openings 46 and 49. These relationships are of importance as will be apparent from the foregoing discussion, and from the method of operating the apparatus described hereinafter.

A typical method of operating the apparatus of the invention is described hereinafter. The communion tray 66 to be used is placed upon the turntable 42 and positioned so that their respective centers are in vertical alignment and also such that their circumferences are in concentric alignment. The three communion tray adjusting means 56 are then adjusted so that the rubber layers 65 lighty touch the circumference of the communion tray 66. The empty communion tray 66 used in the adjustment step is then replaced with a communion tray 66 having concentric rows 69 of empty communion cups 67, with or without a centrally located empty communion cup 68. The slide 34 is then pulled outward to the position illustrated in phantom line, the communion tray 66 bearing the empty communion cups 67 is pushed into position with its circumference lightly touching the rubber layers 65, and the slide 34 is pushed inward to its maximum inward position, i.e., until stops 40 and 41 strike transversely extending portion 25, as illustrated in FIG. 1 of the drawings. The height of the liquid storage and dispensing mechanism 70 is then adjusted so that the tip of copper tubing 102 used as a filling spout is approximately one-quarter to one-half inch above the communion cups 67. This is accomplished by loosening set screws 144 and 145, making the height adjustment as necessary by re-positioning set screws 144 and 145 in slots 142 and 143, respectively, and then tightening set screws 144 and 145 to retain the adjusted position. The container 92 is then filled with liquid, such as grape juice, and the apparatus is ready for use. At this time, the tension on spring 123 has been previously adjusted by nut 131 so that the transverse leg 116 compresses rubber tubing 101 and entirely prevents the flow of liquid therethrough. Upon reference to the drawings, it may be seen that the copper tubing 102 used as a filling spout is initially about one-quarter to one-half inch above the center communion cup 68, and it may be filled in this initial position and without adjustment of either slide 34 or turntable 42 by rotating knob 134 and rod 108 to which it is attached clockwise and cause transverse leg 116 to move inward toward vertical portion 90 a distance sufficient to allow liquid to flow from container 92 through opening 93, copper tubing 94, rubber tubing 101 and copper tubing 102 into communion cup 68. When communion cup 68 is filled, the knob 134 is released, and the knob 134, rod 108 and transverse leg 116 return immediately to their normal positions and the flow of liquid through rubber tubing 101 is stopped. The on-off reaction time is so fast that there is no tendency to overfill the communion cup 68 and drops of liquid do not collect on the tip of copper tubing 102 or drop therefrom. There is also no spillage of liquid. After filling communion cup 68 when present, the slide 34 is then pulled out sufficiently to align the tip of copper tubing 102 with the first concentric row 69 of communion cups 67. The turntable 42 is then rotated to the left or right as desired until the tip of copper tubing 102 is directly above each of the communion cups 67 in the row 69, at which time each of the communion cups 67 is filled as discussed above for communion cup 68. When the first concentric row 69 has been filled by progressively rotating the turntable 42 and filling each individual communion cup 67, then the slide 34 is pulled outward again until the tip of copper tubing 102 is directly above the second concentric row 69 of communion cups. The filling procedure described for the first concentric row 69 is then repeated. When all of the concentric rows 69 of cups 67 have been filled, then the communion tray 66 with its filled communion cups 67 is removed and replaced with a fresh communion tray 66 bearing communion cups 67 arranged in concentric rows and ready for filling. The above mentioned steps followed in filling the first communion tray 66 are then repeated in filling the second and any subsequent communion trays 66. When all of the communion cups 67 have been filled, the surplus liquid in container 92 is then drained therefrom by turning knob 134 clockwise and retaining it in the clockwise position until the surplus liquid has been transferred via copper tubing 102 to a surplus liquid container. The surplus liquid then may be transferred back to its original container and saved for future use. The appartus may be easily cleaned by pouring water into the container 92 and allowing it to drain therefrom as described for the surplus liquid. This flushing procedure with water may be repeated until all traces of the grape juice or other liquid initially present have been removed, and thereafter the container and related apparatus may be wiped dry and clean with a paper towel or the like. All of the foregoing procedures may be performed in a rapid and efficient manner, and without underfilling or overfilling the communion cups 67, or spilling or otherwise wasting the liquid. Additionally, there is no tendency for drops of liquid to collect on and fall from the tip of copper tubing 102.

The foregoing detailed description and the accompanying drawings are for purposes of illustration only, and are not intended as being limiting to the spirit or scope of the appended claims.

I claim:

1. Apparatus for filling containers such as communion cups comprising a longitudinally extending base, the longitudinally extending base having inner and outer end portions including longitudinally extending slide guide means for receiving a slide in slidable relationship thereto, slide means having upper and lower surfaces slidably mounted in the longitudinally extending slide guide means for longitudinal inward and outward movement with respect to the base, a rotatable support having upper and lower surfaces, mounting means carried by the slide for rotatably mounting the support in spaced relationship with respect to the upper surface of the slide, the support including means for supporting a plurality of containers to be filled on or above the upper surface thereof, means for storing liquid to be dispensed and for dispensing controlled amounts thereof into the said plurality of containers to be filled, and mounting means carried by the base for mounting said liquid storage and dispensing means whereby said liquid storage and dispensing means is carried by the base, and wherein the support and said liquid dispensing means are mounted with respect to the longitudinally extending guide means whereby upon moving the slide to a first position in the slide guide means, a first container to be filled with liquid and supported by the support directly above the center of rotation of the support is in a position at which said liquid dispensing means is effective to dispense liquid therein.

2. The apparatus of claim 1 wherein said means for rotatably mounting the support includes at least three ball bearings carried by the upper surface of the slide and positioned in spaced relationship with respect to the center of rotation of the support and circumferentially therearound at intervals of not more than about 120° whereby the support may rest rotatably thereon without substantial tipping.

3. The apparatus of claim 2 wherein the said means for rotatably mounting the support includes height adjusting means whereby the slide and support are vertically spaced and the vertical distance between the slide and support may be adjusted to allow the support to rotatably rest upon the said ball bearings without undue clearance therebetween or binding.

4. The apparatus of claim 2 wherein the undersurface of the support is provided with a wearplate which is contacted by the said ball bearings during rotation of the support.

5. The apparatus of claim 4 wherein said wearplate is constructed from a wear resistant sound-absorbing material whereby the noise resulting from rotation of the support may be kept at an acceptable level.

6. Apparatus for filling containers such as communion cups comprising a longitudinally extending base, the longitudinally extending base having inner and outer end portions including longitudinally extending slide guide means for receiving a slide in slidable relationship thereto, slide means having upper and lower surfaces slidably mounted in the longitudinally extending slide guide means for longitudinal inward and outward movement with respect to the base, a rotatable turntable having upper and lower surfaces, mounting means carried by the slide for rotatably mounting the turntable in spaced relationship with respect to the upper surface of the slide, the turntable including means for supporting a plurality of containers to be filled on or above the upper surface thereof, means for storing liquid to be dispensed and for dispensing controlled amounts thereof into the said plurality of containers to be filled, and mounting means carried by the base for mounting said liquid storage and dispensing means whereby said liquid storage and dispensing means is carried by the base, and wherein the turntable and said liquid dispensing means are mounted with respect to the longitudinally extending guide means whereby upon moving the slide to a first position in the slide guide means, a first container to be filled with liquid and supported by the turntable directly above the center of rotation of the turntable is in a position at which said liquid dispensing means is effective to dispense liquid therein.

7. The apparatus of claim 6 wherein the slide may be moved from said first position to at least one additional position whereby each of the containers in at least one concentric row of containers to be filled with liquid arranged around the center of rotation of the turntable and equidistant therefrom is in a position at which said liquid dispensing means is effective to dispense liquid therein upon rotation of the turntable to successive predetermined positions wherein the said liquid dispensing means is directly above each individual container in a given concentric row at the time of filling the same.

8. The apparatus of claim 1 wherein cooperating stop means are carried by the base and the slide guide means for limiting the maximum longitudinal inward and outward movement of the slide.

9. Apparatus for filling containers such as communion cups comprising a longitudinally extending base, the longitudinally extending base having inner and outer end portions including longitudinally extending slide guide means for receiving a slide in slidable relationship thereto, slide means having upper and lower surfaces slidably mounted in the longitudinally extending slide guide means for longitudinal inward and outward movement with respect to the base, a rotatable turntable having upper and lower surfaces, mounting means carried by the slide for rotatably mounting the turntable in spaced relationship with respect to the upper surface of the slide, the turntable including means for supporting a plurality of containers to be filled on or above the upper surface thereof, means for storing liquid to be dispensed and for dispensing controlled amounts thereof into the said plurality of containers to be filled, and mounting means carried by the base for mounting said liquid storage and dispensing means whereby said liquid storage and dispensing means is carried by the base, and wherein cooperating stop means are carried by the base and the slide guide for limiting the maximum longitudinal inward and outward movement of the slide, and wherein when the slide is in said maximum inward position, the said liquid dispensing means is effective to dispense liquid into a container to be filled with the liquid which is supported by the turntable directly above the center of rotation of the turntable.

10. The apparatus of claim 9 wherein when the slide is in a position outward from said maximum inward position, upon rotation of the turntable to successively different predetermined positions said liquid dispensing means is effective to dispense liquid into each container of a concentric row of containers to be filled with the liquid which is supported by the turntable and arranged equidistant from the center of rotation of the turntable and directly beneath the said liquid dispensing means.

11. The apparatus of claim 1 wherein the support has a generally circular configuration and is rotatably mounted substantially at its geometric center and is rotatable therearound.

12. Apparatus for filling containers such as communion cups comprising a longitudinally extending base, the longitudinally extending base having inner and outer end portions including longitudinally extending slide guide means for receiving a slide in slidable relationship thereto, slide means having upper and lower surfaces slidably mounted in the longitudinally extending slide guide means for longitudinal inward and outward movement with respect to the base, a rotatable turntable having upper and lower surfaces, mounting means carried by the slide for rotatably mounting the turntable in spaced relationship with respect to the upper surface of the slide, the turntable including means for supporting a plurality of containers to be filled on or above the upper surface thereof, means for storing liquid to be dispensed and for dispensing controlled amounts thereof into the said plurality of containers to be filled, and mounting means carried by the base for mounting said liquid storage and dispensing means whereby said liquid storage and dispensing means is carried by the base, and wherein the turntable has a generally circular configuration and is rotatably mounted substantially at its geometric center and is rotatable therearound, cooperating stop means are carried by the base and the slide for limiting the maximum longitudinal inward and outward movement of the slide, the said liquid dispensing means includes a spout means for discharging liquid into the said containers to be filled therewith, and the said spout means is mounted substantially above the center of rotation of the turntable when the slide is in its said maximum inward position.

13. Apparatus for filling containers such as communion cups comprising a longitudinally extending base, the longitudinally extending base having inner and outer end portions including longitudinally extending slide guide means for receiving a slide in slidable relationship thereto, slide means having upper and lower surfaces slidably mounted in the longitudinally extending slide guide means for longitudinal inward and outward movement with respect to the base, a rotatable turntable having upper and lower surfaces, mounting means carried by the slide for rotatably mounting the turntable in spaced relationship with respect to the upper surface of the slide, the turntable including means for supporting a plurality of containers to be filled on or above the upper surface thereof, means for storing liquid to be dispensed and for dispensing controlled amounts thereof into the said plurality of containers to be filled, and mounting means carried by the base for mounting said liquid storage and dispensing means whereby said liquid storage and dispensing means is carried by the base, and wherein the turntable has a generally circular configuration and is rotatably mounted substantially at its geometric center and is rotatable therearound, and wherein the turntable is provided with a plurality of at least three means for horizonatally positioning on the upper surface of the turntable a generally circular tray on which containers to be filled with liquid are supported, the said horizontally positioning means being spaced substantially equal distances from the said center of rotation of the turntable whereby the said circular tray may be positioned circumferentially thereagainst with its geometric center substantially directly above the said center of rotation.

14. The apparatus of claim 13 wherein the said positioning means has upwardly projecting portions which fit against the circumference of the said tray and the upwardly projecting portions are provided with a resilient non-marring surface which prevents surface damage to the circumference of the tray.

15. The apparatus of claim 1 wherein said means for storing liquid to be dispensed and for dispensing controlled amounts thereof and the said mounting means therefor include container means for storing liquid to be dispensed, mounting means carried by the base for mounting said container for storing liquid above the upper surface of the support, liquid withdrawal and dispensing means for withdrawing liquid from said container means and dispensing controlled amounts of the withdrawn liquid into the said plurality of containers to be filled, and mounting means carried by the base for mounting said liquid withdrawal and dispensing means above the upper surface of the support and below said container means whereby said liquid may be withdrawn and dispensed with the aid of gravity.

16. The apparatus of claim 15 wherein the said liquid withdrawal and dispensing means includes upright conduit means for withdrawing liquid from the container means with the aid of gravity, the conduit means including a flexible resilient rubber tubing having upper and lower ends, means for normally applying pressure to the outside wall of said tubing intermediate the upper and lower ends to thereby compress the same and prevent liquid from normally flowing through the tubing, and means for rendering said pressure applying means temporarily ineffective whereby the tubing wall is no longer compressed and liquid is temporarily free to flow through the tubing with the aid of gravity.

17. The apparatus of claim 16 wherein the said conduit means includes a section of copper tubing, the section of copper tubing being inserted in the lower end of the rubber tubing in liquid tight relationship, and the section of copper tubing depending downward from the rubber tubing and serving as a dripless filling spout.

18. The apparatus of claim 16 wherein the said means for normally applying pressure to the outside wall of the rubber tubing includes a substantially unyielding upright surface extending longitudinally along one side of the upright rubber tubing, a substantially unyielding surface extending transversely across the wall of the rubber tubing on the side thereof opposite the said unyielding upright surface, and resilient means for normally urging said unyielding transversely extending surface toward said unyielding upright surface whereby the wall of the rubber tubing is normally compressed therebetween and liquid is normally prevented from flowing through the rubber tubing.

19. The apparatus of claim 18 wherein the said resilient means is a spring which normally urges the said unyielding transversely extending surface toward said unyielding upright surface.

20. The apparatus of claim 18 wherein the said transversely extending surface is mounted on one end of an elongated member and a spring is mounted on the other end of the elongated member, the elongated member is fixedly mounted on a rod intermediate the said transversely extending surface and the said spring, the rod is rotatably mounted and the spring is under tension and mounted whereby it tends to rotate the rod in a first direction whereby the transversely extending surface is moved toward said unyielding upright surface, and the transversely extending surface is normally urged into contact with the upright surface by the tension on the spring.

21. The apparatus of claim 20 wherein the said means for rendering the pressure applying means temporarily ineffective includes a knob attached to the said rod whereby the said rod may be rotated thereby in a direction opposite to the direction of rotation imparted to the rod by the said spring and whereby the tension on the spring is overcome and the said transversely extending surface is moved away from the upright surface thereby preventing the rubber tubing from being compressed and allowing liquid to flow through the rubber tubing temporarily.

* * * * *